United States Patent [19]

Neuroth

[11] Patent Number: 4,959,022

[45] Date of Patent: Sep. 25, 1990

[54] ELECTRICAL CONNECTOR FOR HIGH PRESSURE APPLICATIONS WITH RAPID PRESSURE TRANSIENTS

[75] Inventor: David H. Neuroth, Hamden, Conn.

[73] Assignee: Hubbell Incorporated, Orange, Conn.

[21] Appl. No.: 400,684

[22] Filed: Aug. 30, 1989

[51] Int. Cl.[5] ..... H01R 13/40

[52] U.S. Cl. ..... 439/589; 439/738; 29/857

[58] Field of Search ..... 439/271, 272, 273, 274, 439/275, 276, 277, 279, 281, 587, 589, 738, 462, 583; 174/77 R; 285/95, 97, 101, 111, 112, 113; 277/205, 208, 84; 29/857, 870, 876

[56] References Cited

U.S. PATENT DOCUMENTS

| | | | |
|---|---|---|---|
| 1,795,541 | 3/1931 | Brownell | 285/111 X |
| 1,904,250 | 4/1933 | Purvis | 285/106 X |
| 2,017,994 | 10/1935 | Spang | 285/111 X |
| 2,306,160 | 12/1942 | Freyssinet | 285/97 X |
| 2,331,615 | 10/1943 | Meyer | 439/271 X |
| 2,356,351 | 8/1944 | Phillips | 285/95 X |
| 2,384,281 | 9/1945 | Carter | 285/95 X |
| 3,279,806 | 10/1966 | Bialkowski | 277/205 |
| 3,474,391 | 10/1969 | Gartzke et al. | 439/462 |
| 3,550,065 | 12/1970 | Phillips | 439/272 |
| 4,272,108 | 6/1981 | Maasberg | 285/95 |
| 4,305,638 | 12/1981 | Hutter | 439/583 |
| 4,500,119 | 2/1985 | Geberth, Jr. | 285/276 |
| 4,652,024 | 3/1987 | Krohn | 285/111 |

FOREIGN PATENT DOCUMENTS

| | | | |
|---|---|---|---|
| 0739339 | 7/1966 | Canada | 285/97 |
| 2503827 | 10/1982 | France | 285/95 |

OTHER PUBLICATIONS

"Hubbell Connector", sold prior to Aug. 30, 1988.

*Primary Examiner*—Neil Abrams
*Assistant Examiner*—Khiem Nguyen
*Attorney, Agent, or Firm*—Jerry M. Presson; Alfred N. Goodman

[57] ABSTRACT

An electrical cable connector for conducting electricity across the interface of two areas containing two different fluids having substantially the same pressure and that are subjected to rapid increases in pressure. The electrical cable connector includes a hollow housing positioned between the two areas of fluid, an electrical cable extending into the housing, and a sealing assembly for sealing the space between the electrical cable and the inner surface of the housing to prevent fluids from passing between the two areas. The sealing assembly includes an annular sealing element or elements, optional O-rings, a bushing, a compression spring for axially compressing and thereby radially biasing the sealing element or elements, a conductor connector end, and a locking ring. The sealing elements are pressure energized and are generally U-shaped in longitudinal cross section, having first and second concentric leg portions. A porous material, a series of protrusions, or a substantially incompressible, dielectric flowable material is located between the leg portions of the sealing element or elements to prevent them from collapsing upon themselves due to rapid increases in pressure on the sealing element or elements.

26 Claims, 3 Drawing Sheets

ELECTRICAL CONNECTOR FOR HIGH PRESSURE APPLICATIONS WITH RAPID PRESSURE TRANSIENTS

FIELD OF THE INVENTION

The invention relates to an electrical cable connector for connecting electrical cable across the interface of two areas containing two different fluids. More particularly, the invention relates to an electrical cable connector for use in oil wells with electrical penetrators and oil-filled motors which are subject to rapid changes in pressure. In particular, the electrical cable connector has an annular sealing element located in the space between the inner surface of a housing and the electrical cable, the annular sealing element having a generally U-shaped longitudinal cross section that is pressure energized by one of the fluids from one of the areas during pressure changes.

BACKGROUND OF THE INVENTION

In various applications of electrical power cable, it is necessary to carry electricity from a dirty outside environment to a clean, uncontaminated environment, or vice versa, with such an interface often experiencing rapid pressure changes. For example, in oil wells, connectors are attached to the ends of penetrators and this attachment can experience rapid high pressure changes. If voids exist in the attachment of the connector with the penetrator, hydrostatic pressure will try to force contaminating liquids into the connector, thus leading to poor electrical performance or failure.

Accordingly, in these environments, the main problem associated with the connectors of penetrators is to avoid disruption of the electrical connection due to leakage in the connector and exposure of the electrical conductors to oil, brine and other oil well fluids. In addition, these connectors must be operable in environments subject to rapid increases in pressure such as from 1,000 psi to 3,000 psi when valves and pumps in the system are opened or closed or energized or de-energized.

While various prior art connectors used in these environments are known, they have numerous disadvantages. First, many of these devices have precisely molded mating parts that require careful installation to control how tightly the mating parts should be screwed together. If these parts are not adequately tightened, voids remain, and if overtightened, their seals are distorted and cannot function properly. Other designs employ mated elastomeric parts separated by dielectric grease. Again, too much or too little grease can cause problems. Moreover, common to both of these approaches is the problem of unequal amounts of compression between a steel part and an elastomeric part when there is a sudden increase in pressure. Accordingly, when there is a sudden increase in pressure, an elastomeric insulation layer on an electrical cable and an elastomeric seal will experience a sudden momentary reduction in volume due to the collapse of microvoids within the elastomer, causing volumetric compression of the polymer itself. This volume reduction is a transient condition because the elastomer soon absorbs sufficient high pressure fluids to restore stress distribution within the elastomeric matrix, thereby allowing the elastomer to expand back to its natural size. Thus, dirty contaminated outside fluid can momentarily leak between the seal and the cable to the inside of the connector in these prior art devices.

Examples of these prior art devices which utilize various sealing assemblies are disclosed in the following U.S. Pat. Nos.: 1,795,541 to Brownell; 1,904,250 to Purvis; 2,017,994 to Spang; 2,331,615 to Meyer; 3,279,806 to Bialkowski; 4,500,119 to Geberth, Jr.; and 4,652,024 to Krohn.

This invention addresses this problem in the art, along with other needs which will become apparent to those skilled in the art once given this disclosure.

SUMMARY OF THE INVENTION

Accordingly, a primary object of the invention is to provide an electrical cable connector that maintains the integrity of its seal during rapid pressure increases and across fluid interfaces.

Another object of the invention is to provide a seal arrangement in an electrical cable connector in which the seal is pressure energized by a sudden increase in pressure of the outside fluid.

Another object of the invention is to provide an electrical cable connector that can be used in conjunction with a penetrator and maintains equilibrium between two adjacent areas.

The foregoing objects are basically attained by providing an electrical cable connector, the combination comprising an electrical cable including an electrical conductor having a layer of elastomeric insulation thereon; a hollow housing receiving a portion of the electrical cable therein and having an inner surface; and a sealing arrangement located in the housing for sealing the space between the inner surface of the housing and the electrical cable. The sealing arrangement comprises an annular sealing element surrounding the electrical cable, having a generally U-shaped longitudinal cross section, and including first and second concentric leg portions extending generally axially in the housing, the first leg portion engaging and sealing against the inner surface of the housing and the second leg portion engaging and sealing against the elastomeric insulation of the electrical cable, and a positioning member, coupled to the housing, for axially restraining the sealing element within the housing.

The foregoing objects are also basically attained by the method of conducting electricity between first and second areas of fluid having substantially the same pressure and that are subjected to rapid increases in pressure, comprising the steps of inserting an electrical cable having an electrical conductor with a layer of elastomeric insulation thereon into a hollow housing having first and second open ends and inner and outer surfaces; forming a first sealing zone in the housing between the first and second areas by sealing between the inner surface of the housing and the electrical cable with an annular sealing element having a generally U-shaped longitudinal cross section, and including first and second concentric leg portions extending axially in the housing, the first leg portion engaging and sealing against the inner surface of the housing and the second leg portion engaging and sealing against the elastomeric insulation of the electrical cable; placing the housing into a bore formed in a body member between the first and second areas with the first end of the housing exposed to the fluid in the first area and the second end of the housing exposed to the fluid in the second area; forming a second sealing zone outside of the housing between the first and second areas by sealing between the outer surface of the housing and the bore of the body member; and maintaining the pressure of the fluid in the first area substantially equal to the pressure in the second area, thereby resisting passage of fluid between the first and second areas.

Other objects, advantages and salient features of the invention will become apparent from the following detailed description, which, taken in conjunction with the annexed drawings, discloses two embodiments of the present invention.

BRIEF DESCRIPTION OF THE DRAWINGS

Referring now to the drawings which form part of this original disclosure.

DETAILED DESCRIPTION OF THE INVENTION

Figure 1:
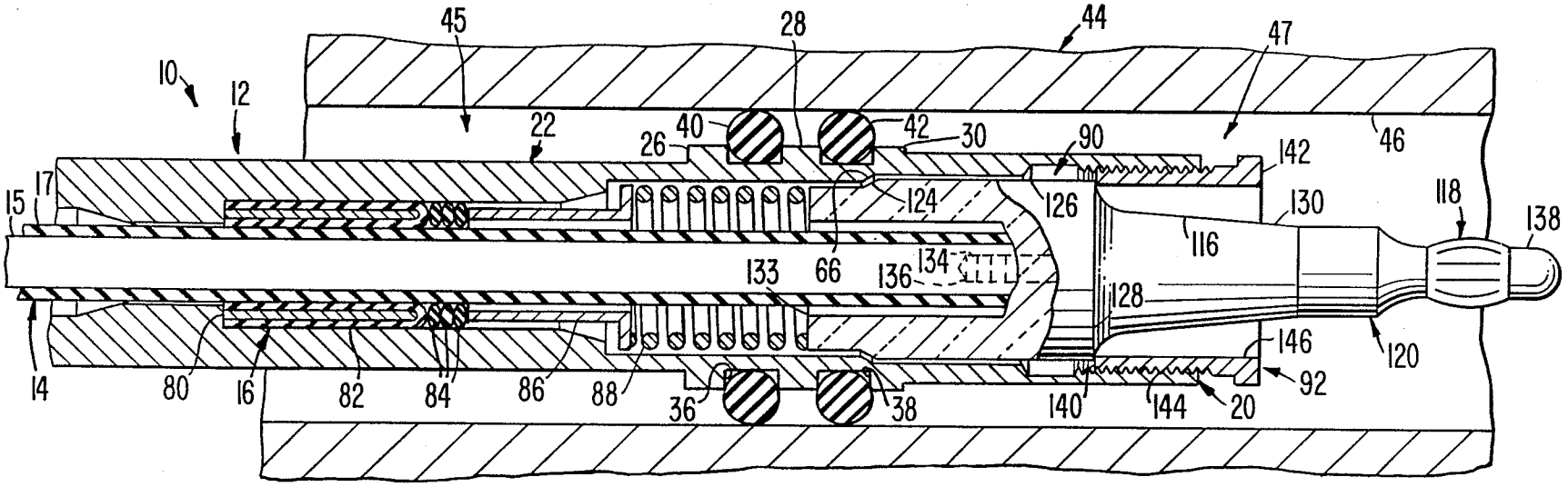
FIG. 1 is a partial, longitudinal cross-sectional elevational view of an electrical cable connector slidably positioned within a portion of a penetrator housing in accordance with the present invention.

As seen in FIG. 1, the electrical cable connector 10 in accordance with the present invention comprises a generally cylindrical hollow connector housing 12 receiving a portion of electrical cable 14 therein and a sealing assembly 16 located in housing 12 for sealing the annular space between housing 12 and electrical cable 14.

Figure 6:
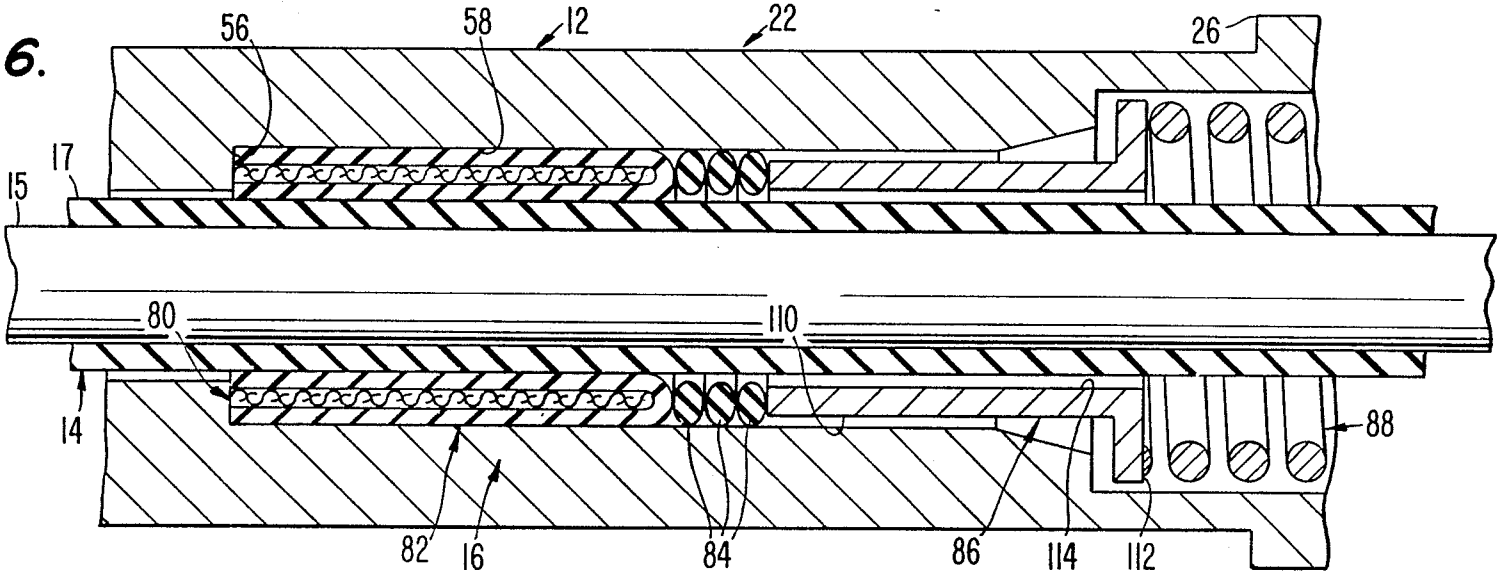
FIG. 6 is an enlarged, partial, longitudinal, cross-sectional elevational view of the sealing assembly of FIGS. 1–4 positioned within the connector housing.
Figure 7:
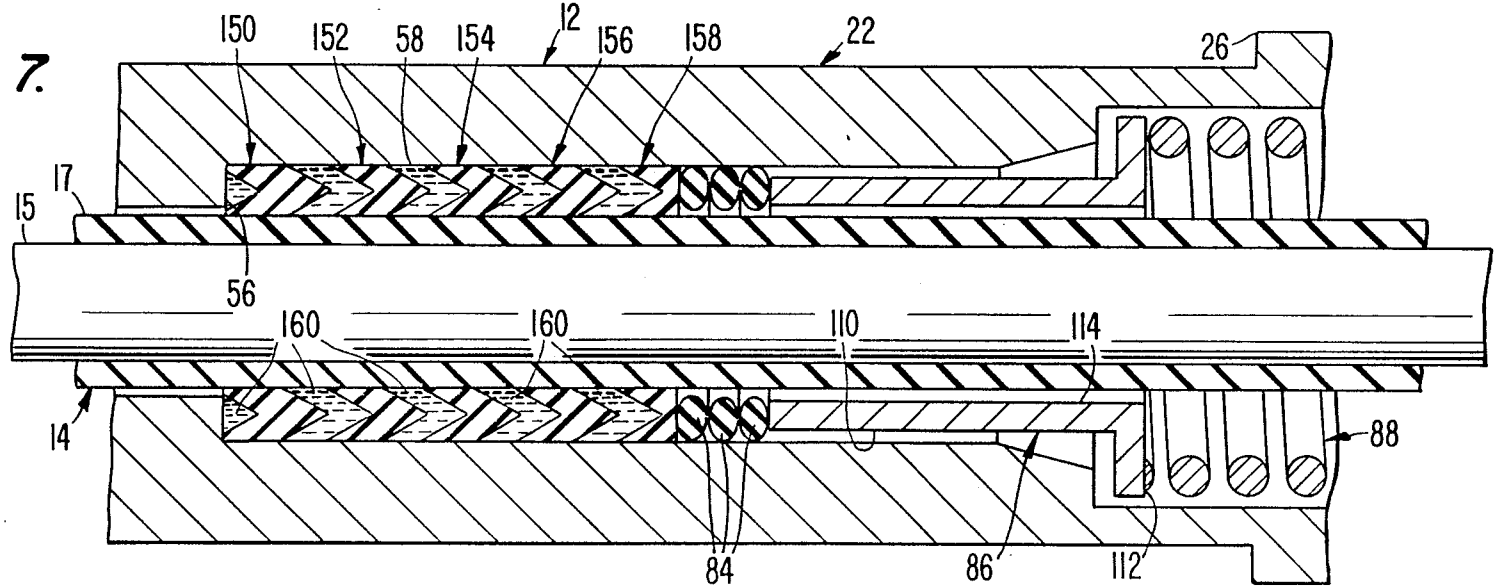
FIG. 7 is an enlarged, partial, longitudinal, cross-sectional elevational view of the second embodiment of the sealing assembly of FIG. 5 positioned within the connector housing.

Electrical cable 14 has a copper conductor 15 surrounded by a layer of elastomeric insulation 17, as seen in FIGS. 1, 6 and 7. Insulation 17 is preferably formed of ethylene propylene dimonomers and can be coated with a polymeric chemical barrier on its outer surface, such as that sold under the trademark KYNAR, to protect conductor 15 from corrosion. Insulation 17 could also be natural or synthetic rubber.

Figure 2:
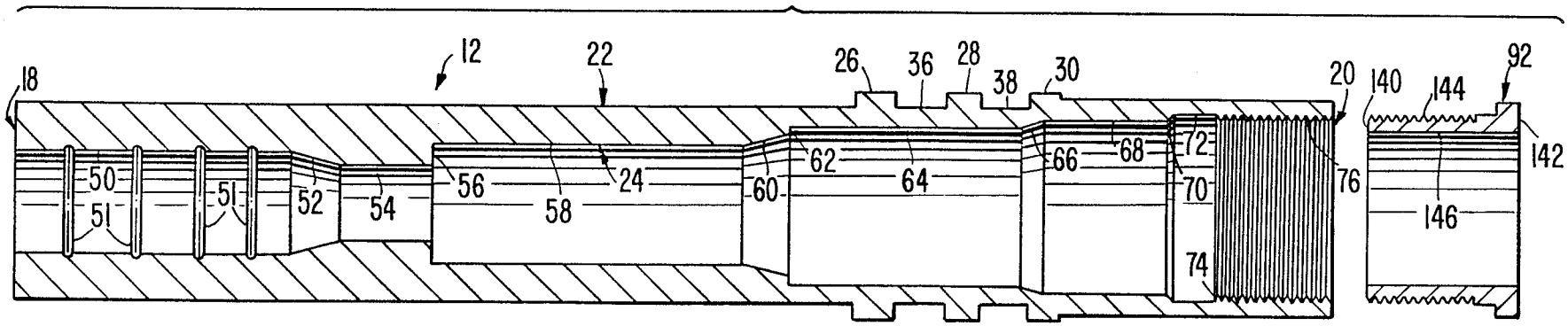
FIG. 2 is an exploded longitudinal cross-sectional elevational view of the housing and locking ring of the electrical cable connector shown in FIG. 1.

Referring now to FIG. 2, connector housing 12 has a first open end 18, a second open end 20, a generally cylindrical outer surface 22 and a generally cylindrical inner surface 24. Outer surface 22 has three axially spaced annular flanges 26, 28 and 30 forming a pair of annular grooves 36 and 38 therebetween for receiving, as seen in FIG. 1, elastomeric and resilient O-rings 40 and 42.

As illustrated in FIG. 1, electrical cable connector 10 is slidably received in cylindrical bore 46 of, for example, a penetrator housing 44. The penetrator is more fully described in U.S. Pat. No. 4,854,886 issued Aug. 8, 1989, Ser. No. 06/912,824, filed Sept. 29, 1986, and entitled "Electrical Penetrator for Hot, High Pressure Service", in the name of David H. Neuroth, and which is incorporated herein by reference. O-rings 40 and 42 seal the annular space between outer surface 22 of connector housing 12 and bore 46 of the penetrator housing 44 for separating and forming an interface between a first or outside area 45 containing a first fluid and a second or inside area 47 containing a second fluid. If a pressure differential occurs between the two areas and across electrical cable connector 10, then electrical cable connector 10 will slide within bore 46 towards the area of lower pressure to equalize the pressure between the two areas. Accordingly, this arrangement insures that the pressure of the first fluid is substantially equal (i.e., ±25 psi) to the pressure of the second fluid.

Referring again to FIG. 2 and connector housing 12, inner surface 24 of housing 12, starting from the first open end 18, includes a first cylindrical portion 50, including four spaced annular grooves 51, an inwardly tapering frustoconical portion 52, a second cylindrical portion 54, an annular, axially-facing abutment surface 56, a third cylindrical portion 58, an outwardly tapering frustoconical surface 60, an axially-facing circumferential shoulder 62, a fourth cylindrical portion 64, an outwardly tapering frustoconical abutment surface 66, a fifth cylindrical portion 68, a first annular transition surface 70, a sixth cylindrical portion 72, a second annular transition surface 74 and an internally threaded portion 76 adjacent to second open end 20 of housing 12.

Sealing assembly 16, as particularly seen in FIGS. 1, 3, 4 and 6, includes a cylindrical spacing element 80, an annular resilient and elastomeric sealing element 82, three resilient and elastomeric O-rings 84, a bushing 86, a compression spring 88, a conductor connector end 90 and a locking ring or jamb nut 92. Sealing element 82 can be formed of ethylene propylene dimonomers, natural rubber or synthetic rubber.

Figure 4:
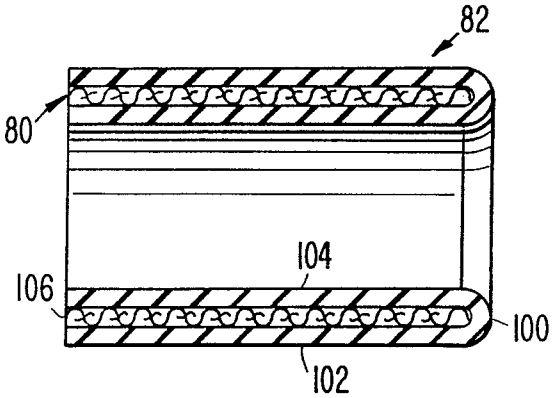
FIG. 4 is an enlarged, longitudinal cross-sectional elevational view of an annular sealing element with the spacer element positioned between its concentric legs shown in FIG. 1.

Referring to FIG. 4, spacer element 80 and sealing element 82 are shown in their assembled position. Sealing element 82 is generally U-shaped in longitudinal cross section and includes an annular bight portion 100, an outer cylindrical leg portion 102 and an inner cylindrical leg portion 104. Spacer element 80 is located between outer leg portion 102 and inner leg portion 104 for maintaining a substantially cylindrical space 106 between outer and inner leg portions 102 and 104. This arrangement permits fluid from the first area 45 to enter between outer and inner leg portions 102 and 104 to pressure energize sealing element 82 (i.e., forcing outer leg 102 against inner surface 24 of housing 12 and inner leg 104 against insulation 17 of cable 14).

When assembled, sealing element 82 and spacer element 80 are located in third cylindrical portion 58 of housing 12. The free ends of outer and inner leg portions 102 and 104 and the adjacent end of spacer element 80 abut against annular abutment surface 56 to prevent axial movement of sealing assembly 16 towards first open end 18. Outer leg portion 102 preferably fits into and bears against third cylindrical portion 58 with a slight interference fit. Inner leg portion 104 preferably fits over and bears against the outer surface of cable insulation 17 with a slight interference fit.

Spacer element 80 is preferably formed of a porous material such as woven fabric. Various woven fabrics may be utilized, such as nylon, cotton, or acrylic. For long term, high-temperature applications, a woven tetrafluoroethylene sold under the trademark TEFLON or a fiberglass material may be used.

Figure 3:
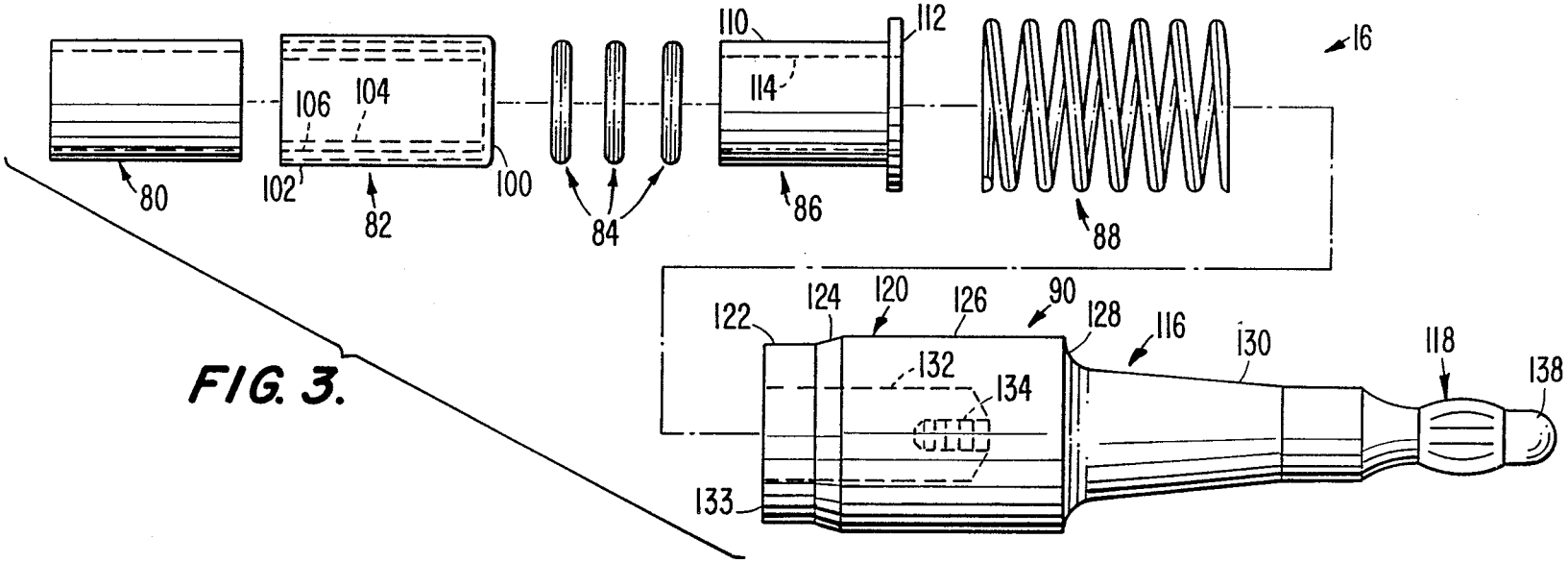
FIG. 3 is an exploded elevational view of the sealing assembly of the electrical cable connector in accordance with the present invention shown in FIG. 1.

As seen in FIGS. 1 and 3, O-rings 84 serve as spacers to obtain the proper compression on annular sealing element 82 by spring 88. Accordingly, O-rings 84 may be eliminated if sealing element 82 or bushing 86, or both, are extended axially to make up the difference of O-rings 84 to assure proper compression on annular sealing element 82.

Bushing 86, as seen in FIGS. 1, 4, 6 and 7, includes a cylindrical portion 110 and an annular flange portion 112. Cylindrical portion 110 has an internal cylindrical bore 114 sized to receive a portion of cable 14 therethrough. Annular flange 112 extends generally perpendicular to cylindrical portion 110 for engaging spring 88 when in its assembled position as particularly seen in FIGS. 6 and 7.

Spring 88, as seen in FIGS. 1, 6 and 7, is positioned within fourth cylindrical portion 64 of housing 12 and exerts an axial force of about 17 pounds when compressed to its operative position. Spring 88 can be, for example, a G-48 spring manufactured by the Century Spring Co.

Referring to FIGS. 1 and 3, conductor connector end 90 includes a dielectric housing 116 and a brass conducting pin 118 extending through the center of housing 116. Housing 116 is preferably made of a dielectric glass reinforced polymeric material, such as polyetheretherketone (PEEK) and is fitted onto the brass pin 118.

Housing 116 has an outer surface 120 which includes a first cylindrical section 122, an outwardly extending frustoconical abutment surface 124, a second cylindrical section 126, an annular abutment surface 128 and a multi-surfaced tapering section 130. A bore 132 extends axially part way through housing 116 from its first end 133 for receiving a portion of cable 14 therein.

Conducting pin 118 has a threaded end 134 extending into bore 132 of housing 116 and a connecting end 138 for electrical coupling to a female connector (not shown). Threaded end 134 is threadedly received in bore 136 of cable 14 for rigidly coupling conductor connector end 90 to cable 14 as seen in FIG. 1.

Referring specifically to FIGS. 1 and 2, locking ring 92 is a generally cylindrical sleeve and includes a first end 140, a second end 142, an externally threaded portion 144, and a cylindrical bore 146 extending axially therethrough.

When assembled, externally threaded portion 144 of locking ring 92 is threadedly received in internally threaded portion 76 of housing 12 with first end 140 of locking ring 92 contacting annular abutment surface 128 of conductor connector end 90.

EMBODIMENT OF FIGS. 5 AND 7

Figure 5:
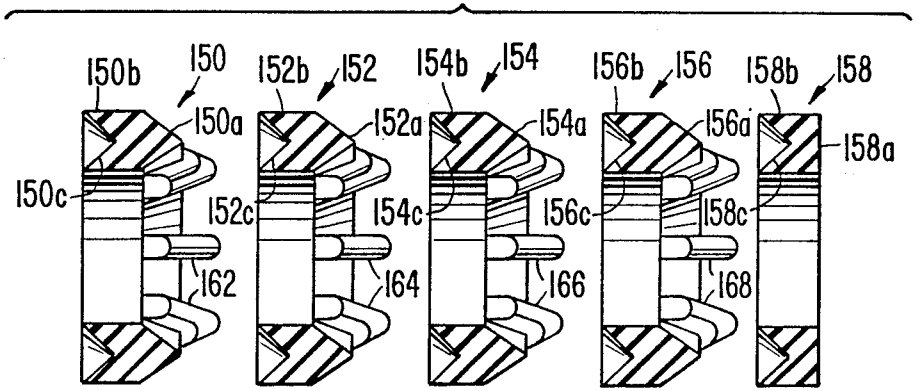
FIG. 5 is an enlarged, exploded elevational view of a second embodiment of a sealing element in longitudinal cross-section in accordance with the present invention and in the form of a plurality of annular sealing rings.

Referring now to FIGS. 5 and 7, a second embodiment of the present invention is illustrated and includes a plurality of sealing rings or elements 150, 152, 154, 156 and 158, which have generally U-shaped annular recesses on one end and which replace elongated U-shaped sealing element 82 of the first embodiment. Each of the sealing elements 150, 152, 154, 156 and 158 includes an annular bight portion **150*a*, 152*a*, 154*a*, 156*a* and 158*a*, respectively, an annular outer leg portion 150*b*, 152*b*, 154*b*, 156*b* and 158*b*, respectively, and an annular inner leg portion 150*c*, 152*c*, 154*c*, 156*c* and 158*c*, respectively. Sealing elements 150, 152, 154, 156 and 158 are all substantially identical, except bight portions 150*a*, 152*a*, 154*a* and 156*a* have a pointed angular end surface and a plurality of equally spaced nubs or protrusions 162, 164, 166 and 168, respectively, while bight portion 158*a* has a flat annular end surface without nubs for engaging O-rings 84 or bushing 86 if O-rings 84 are not used. These sealing elements are elastomeric and resilient and are formed of the same types of materials as sealing element 82**. The nubs are preferably integrally formed with the sealing element.

Preferably, as seen in FIG. 5, there are six to eight generally U-shaped nubs 162, 164, 166 and 168 extending radially and axially from bight portions **150*a*, 152*a*, 154*a* and 156*a*, respectively, and from outer leg portions 150*b*, 152*b*, 154*b* and 156*b* and inner leg portions 150*c*, 152*c*, 154*c* and 156*c*. Nubs 162, 164, 166 and 168 prevent interfacial sealing between adjacent sealing elements 150, 152, 154, 156 and 158. The nubs on the sealing elements engage the U-shaped recess on the adjacent sealing element, thereby maintaining spaces in-between adjacent sealing elements to receive a substantially incompressible, dielectric flowable material 160 therein as seen in FIG. 7**.

In this second embodiment, the spaces between the outer and inner leg portions of sealing elements 150, 152, 154, 156 and 158 are filled with the substantially incompressible, dielectric flowable material 160 such as dielectric grease or oil. The dielectric flowable material 160 and the nubs prevent the inner and outer leg portions of the sealing elements 150, 152, 154, 156 and 158 from collapsing.

Similar to the first embodiment, sealing elements 150, 152, 154, 156 and 158 are pressure energized by the fluid from the first area 45 engaging inner and outer leg portions **150*b* and 150*c* of sealing element 150 and pressing them against insulation 17 of cable 14 and inner surface 24 of housing 12, respectively. If sealing element 150 fails, then the fluid from the first area would pressure energize sealing element 152 and if sealing element 152 fails, then sealing element 154** would be pressure energized, and so on.

In assembling electrical cable connector 10, cable 14 is first placed into connector housing 12 through first open end 18. Sealing element 82 or sealing elements 150, 152, 154, 156 and 158 are then inserted into connector housing 12 and surrounding cable 14 until the sealing element or elements are positioned in third cylindrical portion 58 of housing 12 with a portion of sealing element 82 or sealing element 150 abutting against abutment surface 56 of housing 12. Next, O-rings 84, bushing member 86 and spring 88 are inserted through open end 20 of housing 12 and slid over cable 14. A dielectric grease (not shown for reasons of clarity) is then injected into open end 20 of housing 12 to fill all voids therein. Conductor connector 90 is then threaded onto cable 14. All the assembled parts are now pushed into housing 12 towards end 18, causing a small excess part of the dielectric grease to ooze out of housing 12. Finally, locking nut 92 is screwed into housing 12 and tightened against annular abutment surface 128 of conductor connector end 90 and until frustoconical abutment surface 124 of conductor connector end 90 abuts against frustoconical abutment surface 66 of housing 12 to place the sealing element 82 or elements 150, 152, 154, 156 and 158 under uniform pressure against surface 56 via the biasing effect of spring 88, bushing 86, and O-rings 84. This biasing effect also axially compresses and thereby radially outwardly and inwardly biases the sealing element or elements against the inner surface 24 of connector housing 12 and the outer surface of cable insulation 17 to increase its interference fit therewith and improve its sealing abilities.

Accordingly, if the electrical connector 10 is suddenly subjected to a rapid increase of pressure, the fluid from the first area 45 will cause electrical cable connector 10 to slide within bore 46 of penetrator housing 44 to equalize the pressure between the two areas 45 and 47 and across electrical cable connector 10. Although the pressure across sealing assembly 16 and electrical cable connector 10 is equalized when electrical cable connector 10 moves towards the area of lower pressure, there is a slight momentary, i.e., transient, pressure differential due to the delay of the second area being pressurized. Accordingly, the outside pressure also pressure energizes the U-shaped sealing element to ensure that none of the outside fluid will seep into the inside fluid. This pressure energization results from the increase in fluid pressure between the inner and outer leg portions of the sealing element or elements and tends to bias the outer leg portion radially outwards more firmly against the inner surface 24 of connector housing 12 and the inner leg portion radially inwards more firmly against the outer surface of cable insulation 17.

While only two embodiments have been chosen to illustrate the invention, it will be understood by those skilled in the art that various changes and modifications can be made herein without departing from the scope of the invention as defined in the appended claims.

What is claimed is:

1. An electrical cable connector, the combination comprising:

an electrical cable including an electrical conductor having a layer of elastomeric insulation thereon;

a hollow housing receiving a portion of said electrical cable therein and having an inner surface; and means, located in said housing, for sealing the space between said inner surface of said housing and said electrical cable to prevent said conductor from being exposed to outside fluid, said means for sealing comprising an annular sealing element surrounding said electrical cable, having a generally U-shaped longitudinal cross section, and including first and second concentric leg portions extending generally axially in said housing, said first leg portion engaging and sealing against said inner surface of said housing and said second leg portion engaging and sealing against said elastomeric insulation of said electrical cable, and positioning means, coupled to said housing, for axially restraining said sealing element with said housing.

2. An electrical cable connector according to claim 1, wherein said sealing element is made of elastomeric material.

3. An electrical cable connector according to claim 2, wherein said positioning means includes biasing means for axially compressing and thereby radially biasing said sealing element against said housing and said electrical cable.

4. An electrical cable connector according to claim 3, wherein said biasing means includes a compression spring.

5. An electrical cable connector according to claim 1, wherein said means for sealing further includes a porous member located between said first and second concentric leg portions of said sealing element.

6. An electrical cable connector according to claim 5, wherein said porous member is a woven fabric.

7. An electrical cable connector according to claim 1, wherein said means for sealing further includes a substantially incompressible, dielectric flowable material located between said first and second concentric leg portions of said sealing element.

8. An electrical cable connector according to claim 1, wherein said means for sealing further includes a plurality of said annular sealing elements surrounding said electrical cable.

9. An electrical cable connector according to claim 8, wherein each of said sealing elements has a substantially incompressible, dielectric flowable material located between its said first and second concentric leg portions.

10. An electrical cable connector according to claim 8, wherein some of said sealing elements have a plurality of spaced protrusions thereon engaging the adjacent sealing element.

11. An electrical cable connector, the combination comprising:

an electrical cable including an electrical conductor having a layer of elastomeric insulation thereon;

a hollow housing receiving a portion of said electrical cable therein and having an inner surface; and means, located in said housing, for sealing the space between said inner surface of said housing and said electrical cable to prevent said conductor from being exposed to outside fluid, said means for sealing comprising an elastomeric annular sealing element surrounding said electrical cable, having a generally U-shaped longitudinal cross section, and including first and second concentric leg portions extending generally axially in said housing, said first leg portion engaging and sealing against said inner surface of said housing and said second leg portion engaging and sealing against said elastomeric insulation of said electrical cable, and biasing means, coupled to said housing, for axially compressing and thereby radially biasing said sealing element against said housing and said electrical cable.

12. An electrical cable connector according to claim 11, wherein said biasing means includes a compression spring.

13. An electrical cable connector according to claim 11, wherein said means for sealing further includes a porous member located between said first and second concentric leg portions of said sealing element.

14. An electrical cable connector according to claim 13, wherein said porous member is a woven fabric.

15. An electrical cable connector according to claim 11, wherein said means for sealing further includes a substantially incompressible, dielectric flowable material located between said first and second concentric leg portions of said sealing element.

16. An electrical cable connector according to claim 11, wherein said means for sealing further includes a plurality of said annular sealing elements surrounding said electrical cable.

17. An electrical cable connector according to claim 16, wherein each of said sealing elements has a substantially incompressible, dielectric flowable material located between its said first and second concentric leg portions.

18. An electrical cable connector according to claim 16, wherein some of said sealing elements have a plurality of spaced protrusions thereon engaging the adjacent sealing element.

19. A method of conducting electricity between first and second areas of fluid having substantially the same pressure and that are subjected to rapid increases in pressure, comprising the steps of inserting an electrical cable having an electrical conductor with a layer of elastomeric insulation thereon into a hollow housing having first and second open ends and inner and outer surfaces;

forming a first sealing zone in the housing between the first and second areas by sealing between the inner surface of the housing and the electrical cable with an annular sealing element having a generally U-shaped longitudinal cross section, and including first and second concentric leg portions extending axially in the housing, the first leg portion engaging and sealing against the inner surface of the housing and the second leg portion engaging and sealing against the elastomeric insulation of the electrical cable;

placing the housing into a bore formed in a body member between the first and second areas with the first end of the housing exposed to the fluid in the first area and the second end of the housing exposed to the fluid in the second area;

forming a second sealing zone outside of the housing between the first and second areas by sealing between the outer surface of the housing and the bore of the body member; and maintaining the pressure of the fluid in the first area substantially equal to the pressure in the second area, thereby resisting passage of fluid between the first and second areas.

20. A method according to claim 19, wherein the step of forming a first sealing zone includes the step of axially compressing said sealing element, and thereby radially biasing said sealing element against said housing and said electrical cable.

21. A method according to claim 19, wherein the step of forming a first sealing zone includes the step of maintaining the first and second leg portions of the sealing element apart from each other.

22. A method according to claim 21, wherein the step of maintaining the first and second leg portions apart includes the step of locating a porous material between the first and second leg portions.

23. A method according to claim 21, wherein the step of maintaining the first and second leg portions apart includes the step of locating a substantially incompressible, dielectric flowable material between the first and second leg portions.

24. A method according to claim 19, wherein the step of forming a first sealing zone includes the step of locating a plurality of annular sealing elements in the housing and surrounding the electrical cable.

25. A method according to claim 24, wherein the step of forming a first sealing zone includes the step of maintaining the first and second leg portions of each of the sealing elements apart from each other.

26. A method according to claim 25, wherein the step of maintaining the first and second leg portions of each of the sealing elements apart includes the step of locating a substantially incompressible, dielectric flowable material between the first and second leg portions of each of the sealing elements.

* * * * *